US007701406B1

(12) United States Patent
Horner et al.

(10) Patent No.: US 7,701,406 B1
(45) Date of Patent: Apr. 20, 2010

(54) VARIABLE HEIGHT/THICKNESS RATIO TAPERED SLOT ANTENNA FOR MATCHING IMPEDANCE AND POWER HANDLING

(75) Inventors: Rob Horner, San Diego, CA (US); Rod Cozad, San Diego, CA (US); Hale Simonds, San Diego, CA (US); Robbi Mangra, San Diego, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 421 days.

(21) Appl. No.: 11/726,195

(22) Filed: Mar. 14, 2007

(51) Int. Cl.
*H01Q 13/10* (2006.01)

(52) U.S. Cl. ..... 343/767; 343/770

(58) Field of Classification Search ..... 343/767, 343/770

See application file for complete search history.

(56) References Cited

U.S. PATENT DOCUMENTS 6,008,770 A * 12/1999 Sugawara ..... 343/767
6,317,094 B1 * 11/2001 Wu et al. ..... 343/767
7,009,572 B1 * 3/2006 Homer et al. ..... 343/767
7,088,300 B2 * 8/2006 Fisher ..... 343/767

* cited by examiner

*Primary Examiner*—Shih-Chao Chen
(74) *Attorney, Agent, or Firm*—Kyle Eppele; Stephen E. Baldwin

(57) ABSTRACT

A Variable Height/Thickness Ratio Tapered Slot Antenna For Matching Impedance and Power Handling (NC#98542). The apparatus includes a tapered slot antenna having a gap height and a thickness. The tapered slot antenna includes a first antenna element comprising conductive material, configured to receive and transmit RF signals and a second antenna element comprising conductive material, operatively coupled to said first antenna element, configured to receive and transmit RF signals. A correlation between said gap height and said thickness can be represented by an equation.

1 Claim, 3 Drawing Sheets

500

Front View

Front View (Note: FIGS 2-4 are NOT drawn to scale)

Front View

500

VARIABLE HEIGHT/THICKNESS RATIO TAPERED SLOT ANTENNA FOR MATCHING IMPEDANCE AND POWER HANDLING

FEDERALLY SPONSORED RESEARCH AND DEVELOPMENT

This invention (Navy Case No. 98542) is assigned to the United States Government and is available for licensing for commercial purposes. Licensing and technical inquiries may be directed to the Office of Research and Technical Applications, Space and Naval Warfare Systems Center, San Diego, Code 2112, San Diego, Calif., 92152; voice (619) 553-2778; email T2@spawar.navy.mil. Reference Navy Case Number 98542.

CROSS-REFERENCE TO RELATED APPLICATIONS

This application is related to U.S. Pat. No. 7,009,572, issued on Mar. 7, 2006, entitled "Tapered Slot Antenna", by Rob Horner et al., Navy Case No. 96507, which is hereby incorporated by reference in its entirety herein for its teachings on antennas. This application is also related to U.S. Pat. No. 7,148,855, issued on Dec. 12, 2006, entitled "Concave Tapered Slot Antenna", by Rob Horner et al., Navy Case No. 96109, which is hereby incorporated by reference in its entirety herein for its teachings on antennas.

BACKGROUND OF THE INVENTION

The present invention is generally in the field of antennas.

Typical tapered slot antennas (TSA) are designed with power handling limitations and complex impedance matching networks. One method of increasing power capacity and operating bandwidth of a TSA is to increase the thickness of the TSA. However, increasing thickness produces a change in impedance.

A need exists for tapered slot antennas having higher power handling capability and less complex impedance matching network.

DETAILED DESCRIPTION OF THE INVENTION

The present invention is directed to Variable Height/Thickness Ratio Tapered Slot Antenna For Matching Impedance and Power Handling.

DEFINITIONS

The following acronyms and definitions are used herein:

Acronym(s):

I/O—Input/Output

RF—radio frequency

TSA—Tapered Slot Antenna

VHTR—Variable Height/Thickness Ratio

Definition(s):

Height/Thickness ratio—the ratio between the gap height and thickness of a TSA

The variable height/thickness ratio (VHTR) tapered slot antenna for matching impedance includes a TSA having a gap height correlated to a thickness (i.e., width) to insure a matched impedance. The correlation between gap height and thickness to insure a matched impedance is based on an equation. The VHTR TSA for impedance matching includes an antenna pair having a gap height and a thickness.

Figures 1A, 1B:
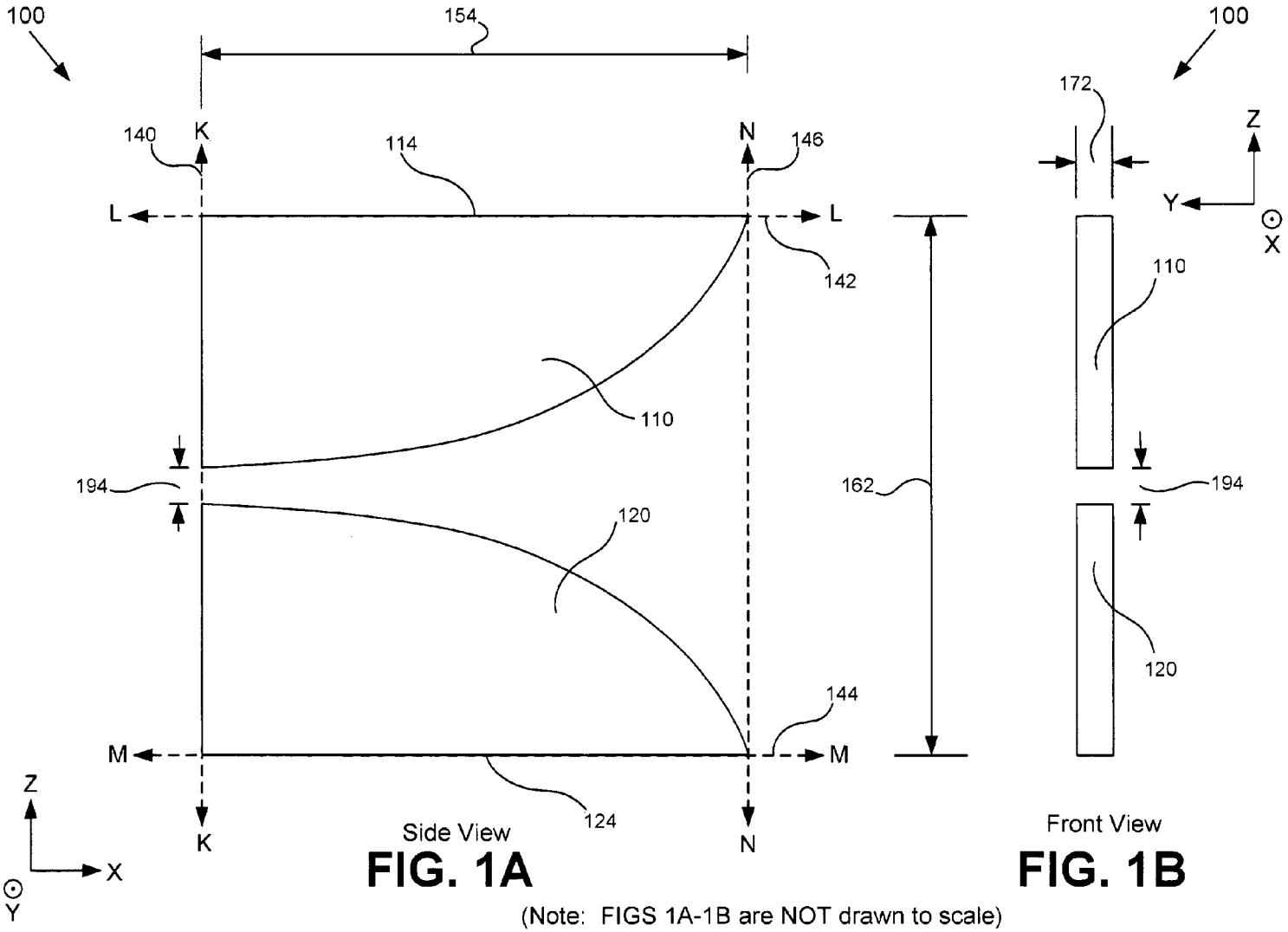
FIG. 1A is a side view of a variable height/thickness ratio tapered slot antenna.
FIG. 1B is a front view of a variable height/thickness ratio tapered slot antenna.

FIG. 1A is a side view of one embodiment of a VHTR tapered slot antenna for impedance matching. As shown in FIG. 1A, VHTR TSA for impedance matching 100 includes an antenna pair (i.e., antenna element 110 and antenna element 120) comprising conductive material. The antenna pair of VHTR TSA for impedance matching 100 has gap height 194, a feed end and a launch end. The feed end of the antenna pair corresponds to the portion of the antenna pair that is proximate to axis 140 (represented by dashed line K-K on FIG. 1A). The feed end receives and transmits signals. The launch end of the antenna pair corresponds to the portion of the antenna pair that is proximate to axis 146 (represented by dashed line N-N on FIG. 1A). Note that the launch end only denotes a location on the antenna pair versus an actual launch point of a particular frequency. Antenna element (AE) 110 has lateral edge 114, which corresponds to the portion of AE 110 that is proximate to axis 142 (represented by dashed line L-L on FIG. 1A). Antenna element 120 has lateral edge 124, which corresponds to the portion of AE 120 that is proximate to axis 144 (represented by dashed line M-M on FIG. 1A).

TSA length 154 of VHTR TSA for impedance matching 100 is defined as the distance between the feed end (proximate to axis 140) and the launch end (proximate to axis 146). TSA height 162 of VHTR TSA for impedance matching 100 is defined as the distance between the lateral edges of the antenna pair (i.e., the distance between lateral edge 114 and lateral edge 124) (i.e., the distance between axis 142 and axis 144).

In one embodiment, TSA antenna elements 110, 120 have curvatures that can each be represented by the following Equation 1:

$$Y(x)=a(e^{bx}-1); \qquad \text{(Equation 1)}$$

where, a and b are parameters selected to produce a desired curvature. In one embodiment, parameters "a" and "b" are approximately equal to 0.2801 and 0.1028, respectively.

FIG. 1B is a front view of one embodiment of a typical TSA. VHTR TSA for impedance matching 100 of FIG. 1B is substantially similar to VHTR TSA for impedance matching 100 of FIG. 1A, and thus, similar components are not described again in detail hereinbelow. As shown in FIG. 1B, VHTR TSA for impedance matching 100 includes an antenna pair (i.e., antenna element 110, antenna element 120). The antenna pair of VHTR TSA for impedance matching 100 has gap height 194. VHTR TSA for impedance matching 100 has TSA thickness 172.

Equation 2 represents the correlation between gap height and TSA thickness (i.e., TSA width) for the VHTR TSA for impedance matching.

$$h = \frac{w \times z_0 \times \sqrt{e_r}}{V \times \pi}; \quad \text{(EQUATION 2)}$$

where h=gap height w=TSA thickness $z_0$=characteristic impedance $e_r$=dielectric constant of dielectric spacing material.

V=a constant having a value greater than or equal to 15 and less than or equal to 100. In one embodiment, V=44.

π=ratio of a circle's circumference to its diameter

As shown above in Equation 2, gap height equals the product of TSA thickness multiplied by characteristic impedance multiplied by the square root of the dielectric constant of dielectric spacing material divided by the product of V multiplied by pi. In one embodiment, V=44. In one embodiment, the dielectric spacing material comprises air. In one embodiment, the dielectric spacing material comprises Teflon®.

In one embodiment, gap height equals 0.135 inches for a VHTR TSA for impedance matching having a TSA thickness of 0.375 inches, a characteristic impedance of 50 ohms, V equal to 44 and a dielectric constant of dielectric spacing material of 1.000536. In one embodiment, gap height equals 0.045 inches for a VHTR TSA for impedance matching having a TSA thickness of 0.125 inches, a characteristic impedance of 50 ohms, V equal to 44 and a dielectric constant of dielectric spacing material of 1.000536. In one embodiment called a Teflon® dielectric spacer embodiment, gap height equals 0.192 inches for a VHTR TSA for impedance matching having a TSA thickness of 0.375 inches, a characteristic impedance of 50 ohms, V equal to 44 and a dielectric constant of dielectric spacing material of 2.

Figure 2:
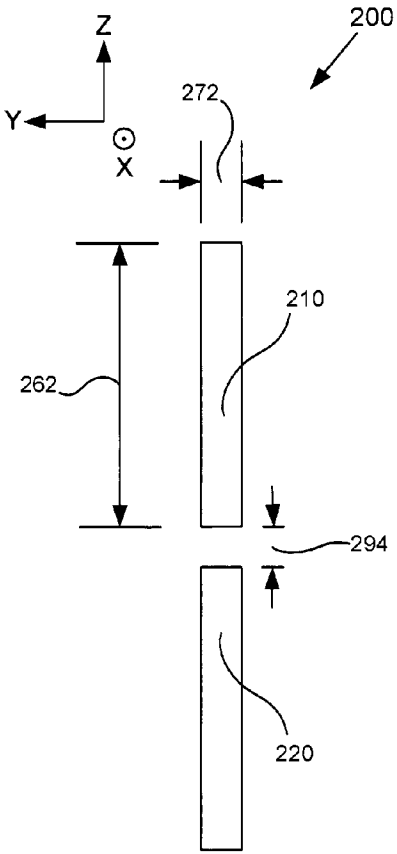
FIG. 2 is a front view of one embodiment of a variable height/thickness ratio tapered slot antenna.

FIG. 2 is a front view of one embodiment of a variable height/thickness ratio tapered slot antenna for impedance matching. VHTR TSA for impedance matching 200 of FIG. 2 is substantially similar to VHTR TSA for impedance matching 100 of FIG. 1B, and thus, similar components are not described again in detail hereinbelow. As shown in FIG. 2, VHTR TSA for impedance matching 200 includes an antenna pair (i.e., antenna element 210 and antenna element 220) comprising conductive material. The antenna pair of VHTR TSA for impedance matching 200 has antenna element height 262, gap height 294 and TSA thickness 272. Antenna element height 262 represents the height of antenna element 210, which is approximately equal to the height of antenna element 220. VHTR TSA for impedance matching 200 has fixed dimensions that allow for a certain power handling capacity. In one embodiment, the fixed dimensions allow for a characteristic impedance ($z_0$) of 50 ohms.

Figure 3:
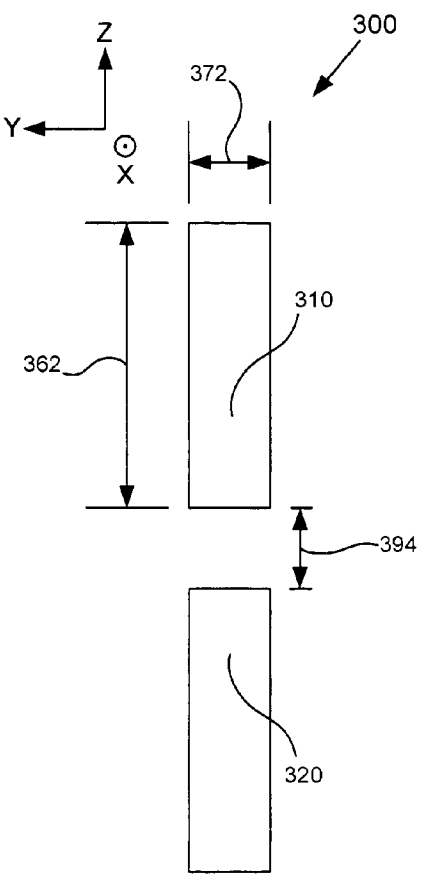
FIG. 3 is a front view of one embodiment of a variable height/thickness ratio tapered slot antenna.

FIG. 3 is a front view of one embodiment of a variable height/thickness ratio tapered slot antenna for impedance matching. VHTR TSA for impedance matching 300 of FIG. 3 is substantially similar to VHTR TSA for impedance matching 100 of FIG. 1B, and thus, similar components are not described again in detail hereinbelow. As shown in FIG. 3, VHTR TSA for impedance matching 300 includes an antenna pair (i.e., antenna element 310 and antenna element 320) comprising conductive material. The antenna pair of VHTR TSA for impedance matching 300 has antenna element height 362, gap height 394 and TSA thickness 372. Antenna element height 362 (which may be equal to antenna element height 262 of FIG. 2) represents the height of antenna element 310, which is approximately equal to the height of antenna element 320. VHTR TSA for impedance matching 300 has fixed dimensions that allow for a certain power handling capacity. In one embodiment, the fixed dimensions allow for a characteristic impedance ($z_0$) of 50 ohms. VHTR TSA for impedance matching 300 of FIG. 3 has higher power handling capacity than VHTR TSA for impedance matching 200 of FIG. 2 because VHTR TSA for impedance matching 300 has a greater TSA thickness 372 compared to TSA thickness 272 of VHTR TSA for impedance matching 200. Thus and according to Equation 2, gap height 394 is greater than gap height 294.

Figure 4:
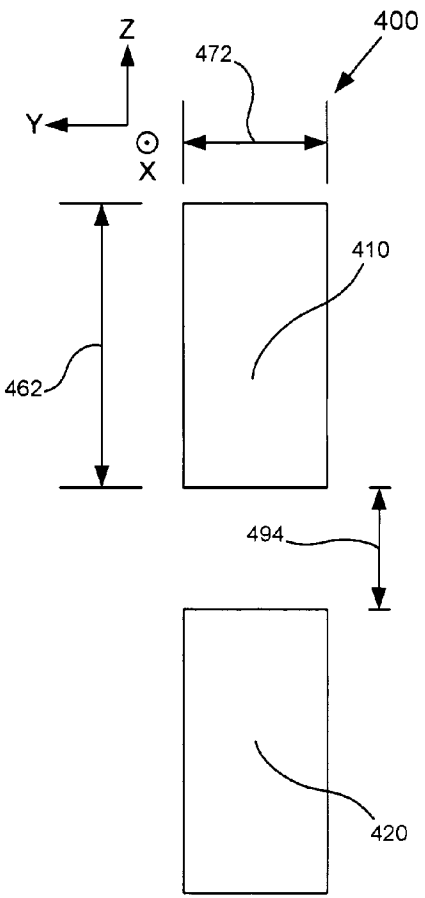
FIG. 4 is a front view of one embodiment of a variable height/thickness ratio tapered slot antenna.

FIG. 4 is a front view of one embodiment of a variable height/thickness ratio tapered slot antenna for impedance matching. VHTR TSA for impedance matching 400 of FIG. 4 is substantially similar to VHTR TSA for impedance matching 100 of FIG. 1B, and thus, similar components are not described again in detail hereinbelow. As shown in FIG. 4, VHTR TSA for impedance matching 400 includes an antenna pair (i.e., antenna element 410 and antenna element 420) comprising conductive material. The antenna pair of VHTR TSA for impedance matching 400 has antenna element height 462, gap height 494 and TSA thickness 472. Antenna element height 462 represents the height of antenna element 410, which is approximately equal to the height of antenna element 420. VHTR TSA for impedance matching 400 has higher power handling capacity than VHTR TSA for impedance matching 300 of FIG. 3 because VHTR TSA for impedance matching 400 has a greater TSA thickness 472 compared to TSA thickness 372 of VHTR TSA for impedance matching 300. Thus and according to Equation 2, gap height 494 is greater than gap height 394.

Figure 5:
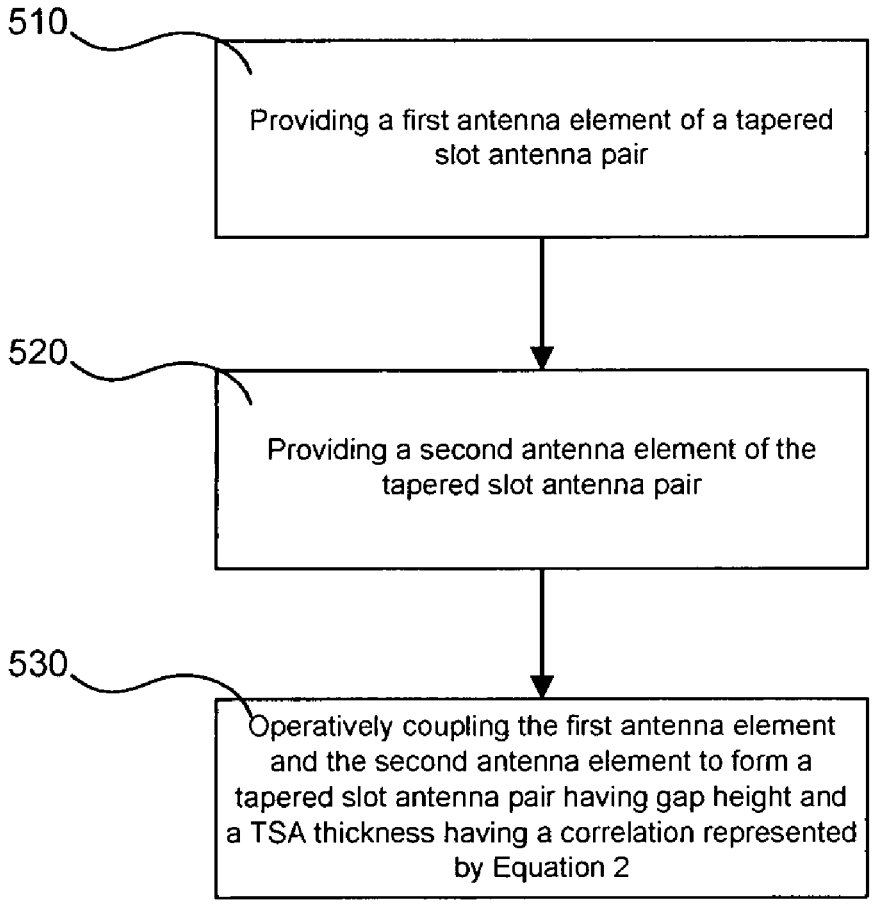
FIG. 5 is a flowchart of an exemplary method of manufacturing one embodiment of a variable height/thickness ratio tapered slot antenna.

FIG. 5 is a flowchart illustrating an exemplary process to implement an exemplary VHTR TSA for impedance matching. While boxes 510 through 530 shown in flowchart 500 are sufficient to describe one embodiment of an exemplary TSACA, other embodiments of the TSACA may utilize procedures different from those shown in flowchart 500.

We claim:

1. An apparatus, comprising:

a tapered slot antenna having a gap height and a thickness, comprising:

a first antenna element comprising conductive material, configured to receive and transmit RF signals;

a second antenna element comprising conductive material, operatively coupled to said first antenna element, configured to receive and transmit RF signals to form a tapered slot antenna (TSA) pair having said gap height and thickness;

wherein a correlation between said gap height and said thickness is represented by the following equation:

$$h = \frac{w \times z_0 \times \sqrt{e_r}}{V\pi};$$

where h=gap height w=TSA thickness $z_0$=characteristic impedance $e_r$=dielectric constant of dielectric spacing material V=a constant having a value greater than or equal to 15 and less than or equal to 100 and $\pi$=ratio of a circle's circumference to its diameter, where increasing or decreasing said TSA thickness in accordance with said variable correlation yields increased power handling capabilities or increased lower frequency response, respectively, for said TSA pair, while simultaneously maintaining an impedance matching in accordance with the values of the w, $z_0$, $e_r$ and V components.

* * * * *